US007824351B2

(12) United States Patent
Heilman

(10) Patent No.: US 7,824,351 B2
(45) Date of Patent: Nov. 2, 2010

(54) FEMININE HYDRO-THERAPEUTIC MASSAGE DEVICE

(76) Inventor: David Heilman, 616 N. State St., Geneseo, IL (US) 61254

( * ) Notice: Subject to any disclaimer, the term of this patent is extended or adjusted under 35 U.S.C. 154(b) by 0 days.

(21) Appl. No.: 11/980,940

(22) Filed: Oct. 31, 2007

(65) Prior Publication Data

US 2008/0091060 A1 Apr. 17, 2008

(51) Int. Cl.
*A61H 33/02* (2006.01)
*A61H 35/00* (2006.01)

(52) U.S. Cl. ..... 601/158; 601/159; 601/167; 601/169; 600/38

(58) Field of Classification Search ..... 601/55, 601/154–160, 167–169; 4/541.1–541.5, 4/567, 568, 559; 600/38
See application file for complete search history.

(56) References Cited

U.S. PATENT DOCUMENTS 3,279,703 A * 10/1966 Steltz et al. ..... 239/433
3,653,377 A * 4/1972 Rebold ..... 601/160
3,731,676 A * 5/1973 Rebold ..... 601/160
3,802,422 A * 4/1974 Hurst ..... 601/160
3,961,382 A * 6/1976 Peterson, Jr. ..... 4/541.4
4,100,917 A * 7/1978 Talge et al. ..... 601/167
4,123,808 A * 11/1978 Guarrera ..... 4/447
4,924,535 A * 5/1990 Yamasaki ..... 4/541.4
4,957,101 A * 9/1990 Hara ..... 4/541.3
5,077,841 A * 1/1992 Sugai ..... 4/541.4
5,097,540 A * 3/1992 Lovitt ..... 4/443
5,216,765 A * 6/1993 Paterson et al. ..... 4/620
5,682,626 A * 11/1997 Banks et al. ..... 4/541.5
5,920,923 A * 7/1999 Jillette ..... 4/541.1
6,401,273 B1 * 6/2002 Fung et al. ..... 4/559

* cited by examiner

*Primary Examiner*—Danton DeMille

(57) ABSTRACT

A portable hydro massage device for submersion in a body of water containing a female user, i.e. a bathtub, provides a local massage to the labium region and a focused stimulant to the female user's clitoris thereby resulting in a superior sensation to the entire body promoting an overall euphoric state and calming effect. The apparatus employs a saddle shaped housing, where the buttocks are placed, and a saddle horn for controlling the stimulus. Disposed within the midsection of the saddle horn is a hydro jet with a driven flow from a circulating water pump that draws suction from the main body of water. The hydro jet is adjustable in pressure and a method is provided for aeration of the water discharged to allow for a rhythmic pulsation effect. The saddle horn may be held and the lower body positioned as needed to focus the discharged stream from the hydro jet to the desired point of the pelvic region.

3 Claims, 7 Drawing Sheets

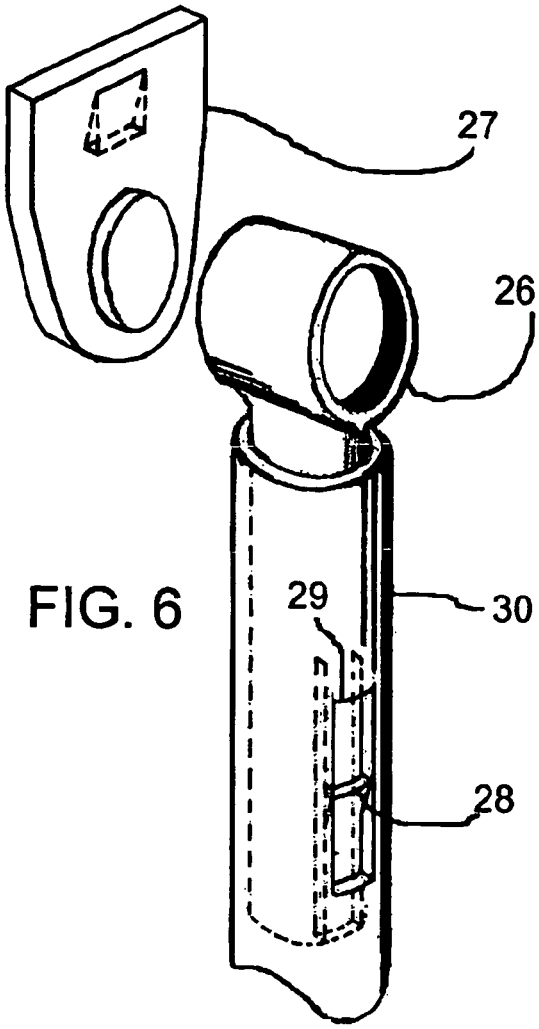
FIG. 6
FIG. 7
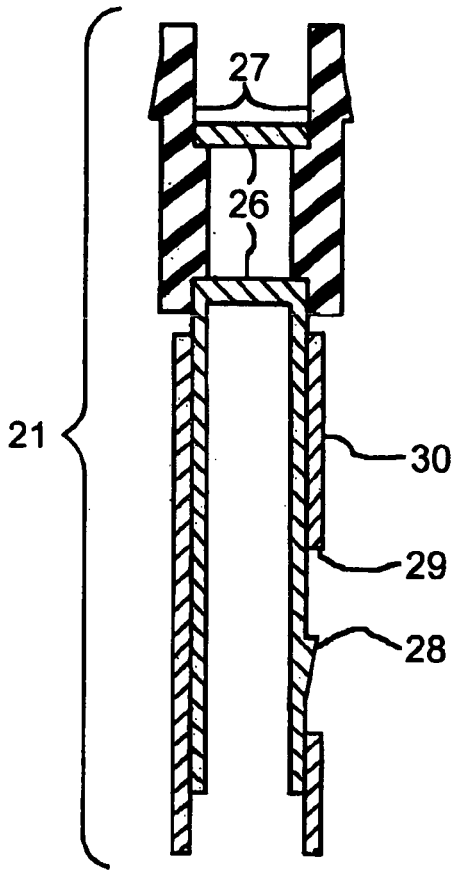

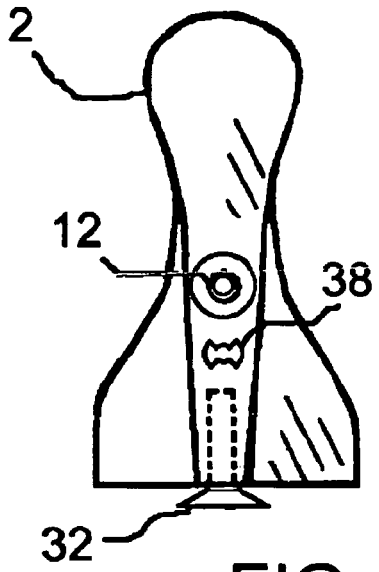
FIG. 8
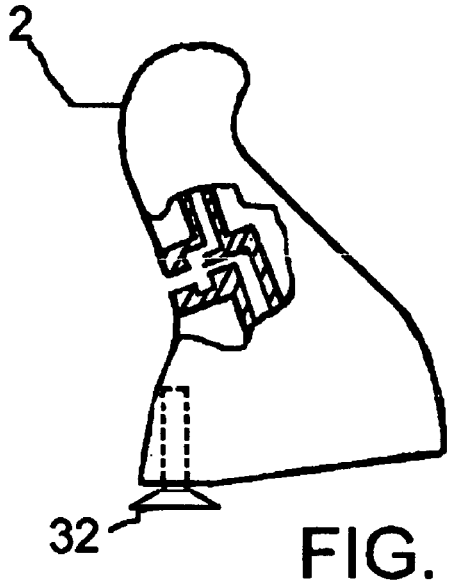
FIG. 9
FIG. 10
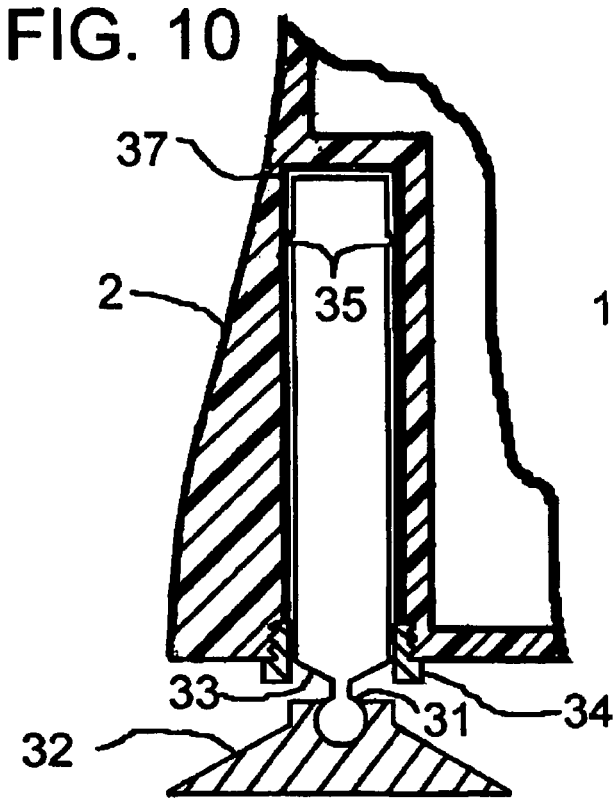
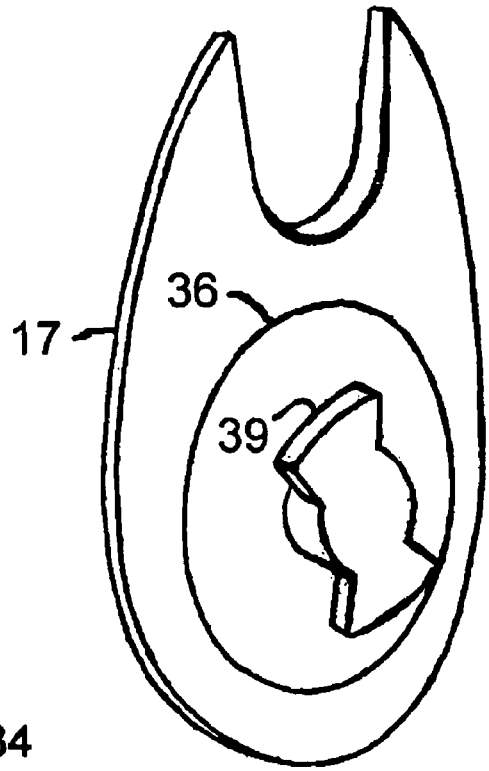
FIG. 11

FIG. 14A
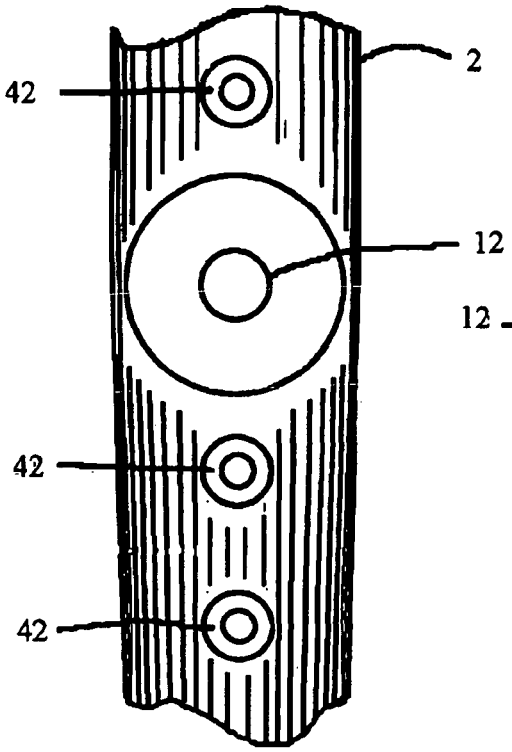
FIG. 14B
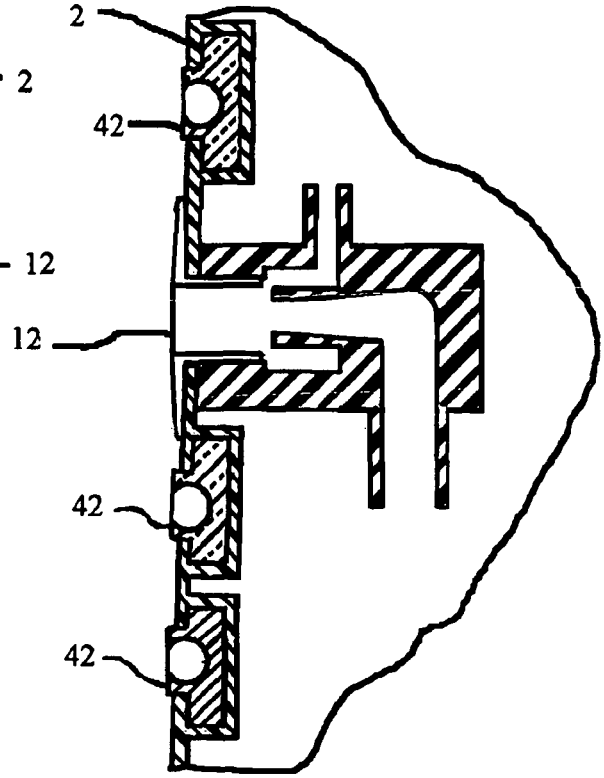
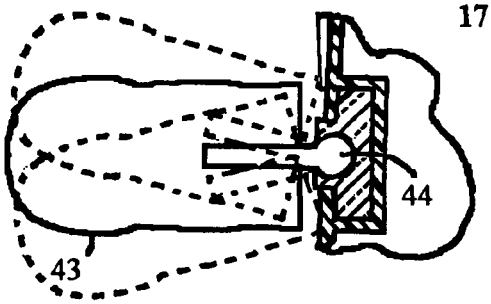
FIG. 14C
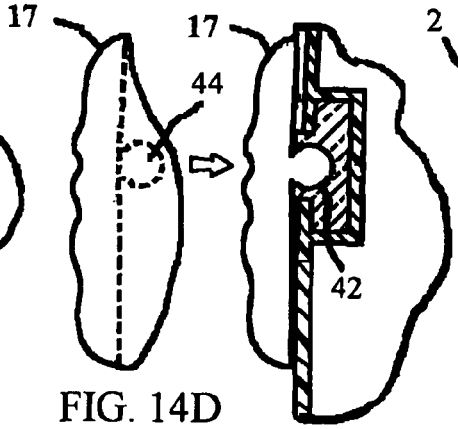
FIG. 14D
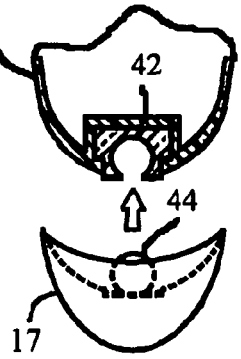
FIG. 14E

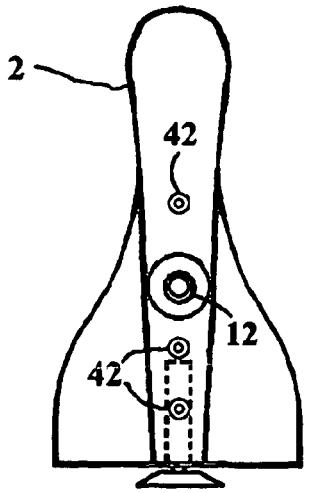
FIG. 15A
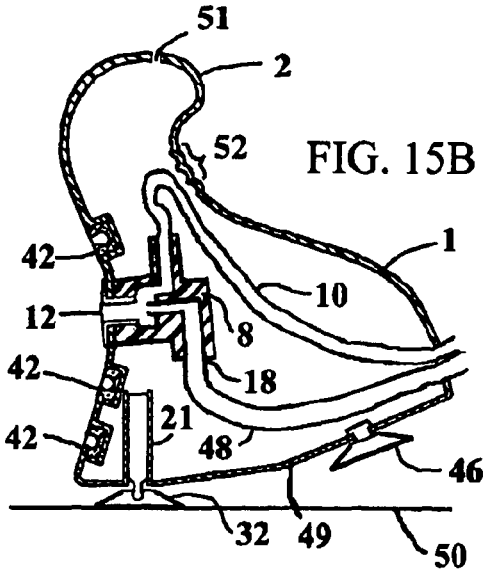
FIG. 15B
FIG. 15C
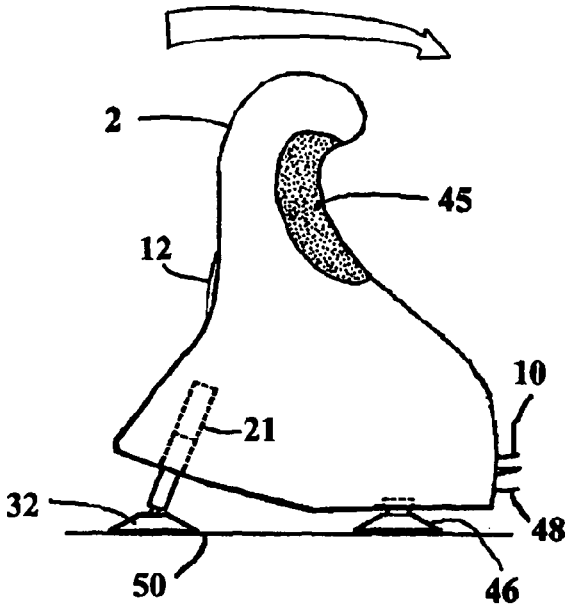

FEMININE HYDRO-THERAPEUTIC MASSAGE DEVICE

CROSS REFERENCE TO RELATED APPLICATIONS

I, David Heilman, residing in Geneseo, Ill. and being a United States citizen, do herein file this non-provisional patent application entitled "Feminine Hydro-therapeutic Massage Device" and claim priority from a non-provisional patent application Ser. No. 11,046,016 filed Dec. 18, 2004, now U.S. Pat. No. 7,335,175 which claimed priority from provisional U.S. patent application Ser. No. 60,551,522 filed on Mar. 5, 2004 and entitled "Feminine Hydro-therapeutic Massage Device", all of which are incorporated by reference herein.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX (Not Applicable)

FIELD OF THE INVENTION

This invention relates to the field of portable hydro-therapeutic stimulation devices for massage therapy to a female user's labium region wherein a method of circulating the water within a small contained body of water such as a spa, shallow pool, or a bathtub is utilized to produce the desired effect.

BACKGROUND OF THE INVENTION

A wide variety of mechanical stimulating devices and a limited number of hydro-therapeutic devices are known in the prior art to affect a massage to the human body to promote stress relief and relaxation. It is a known fact to those skilled in the art that direct stimulation of the typical female clitoris will result in a climax of the entire body, and a plethora of devices have been developed to this end. Mechanical vibratory stimulating devices are diverse and can be used to massage all parts of the human body to effect a soothing relaxation of local musculature and may be used to focus a concentrated effect on a female user's clitoral stimulation point. A general whole body therapy is achieved by use of spas and whirlpools where a plurality of hydro jets are placed around the periphery of the user in a water filled tub setting allowing for circulation, heating and aeration of the water. Hydro pulsating devices in fluid connection with an external water source or a circulated water source are employed in showers, tubs, whirlpools, and personal spas to affect a similar but deeper massage than the vibratory devices. A few of these personal spas employ a method of a hand held local massage as an option.

More recently personal spas and whirlpools have evolved in shape and design to provide a contoured comfortable seating arrangement with strategically placed hydro jets to provide stimulation to predetermined points of the human anatomy such as the back, neck, legs, feet, and pelvic region.

U.S. Pat. No. 5,920,923 issued to Jillette teaches hydro clitoral stimulation in combination with a fixed whirlpool spa environment. As taught by Jillette, and similar to the present invention, air entrained in water allows stimulation to the female genitalia. The unit taught by Jillette, however, is not portable and would be quite costly to purchase, install and maintain. Furthermore, Jillette does not teach a method or apparatus allowing fixed placement combined with fine control of the air-water stream during stimulation.

U.S. Pat. No. 5,077,841 issued to Sugai employs a portable self-contained pumping unit designed to circulate water within a bathtub. The discharge of the pumping unit utilizes a hydro jet with an entrained air mix that is directed at target points to affect a local massage as the user positions oneself near the discharge of the device. A rechargeable battery is used to power the pumping unit. Multiple discharge paths are used to allow the user to select the type of water stream exiting the device. The housing is temporarily attached to the wall of the tub.

U.S. Pat. No. 4,924,535 issued to Yamasaki is based on the same principle as the previously discussed Sugai patent, and uses an external power supply. Yamasaki requires a fixed mounting that would not be easily positioned within the bathtub and allows only limited adjustment by the user. Yamasaki is not practical to effect the variable local stimulation sought by the user. Additionally, Yamasaki provides no teaching on direct or indirect control methods. Furthermore, Yamasaki does not teach any engagement surfaces allowing placement between the user's legs.

U.S. Pat. No. 4,123,808 issued to Guarrera teaches a general area cleansing system using water without aeration. To employ the system, the user most permanently mount a chair to the bathtub. Furthermore, during cleansing, the user has no contact with the nozzle or structure directing the water to the cleansing area thus, limiting the user's control of the air-water stream upon the user.

U.S. Pat. No. 3,902,200 issued to Pratt also teaches a general area cleansing system, referred to as a "Sitz" bath, which also uses water without aeration. To use the system as taught by Pratt, the user must sit immobile in a curved chair located in a bathtub. Pratt does not teach a method or apparatus for adjustment of the direction of the water used for cleansing. Pratt does not teach a method or apparatus allowing engagement between the user's legs or comfortable access to the frontal areas of the user.

U.S. Pat. No. 4,100,917 issued to Talge et. al ("Talge") teaches a portable water circulating device that mounts over the side of the tub to supply a water air mixture over a general area on the bottom of the tub. An optional handheld device connected by a hose to the unit capable of reaching more specific target areas is also taught. No means for removable fixation of the optional handheld device to the tub walls is taught by Talge.

U.S. Pat. No. 5,807,289 is a portable hand held hydro massage device for submerged use and focused stimulation to a user's body parts. As disclosed, this patent does not teach an apparatus or method allowing pivotal fixed mounting at the base of the device.

The prior art disclosed and discussed above indicates weaknesses in the teachings necessary for hydro-therapeutic stimulation of the female genitalia and surrounding regions. The prior art fails to teach finite control of the stimulation stream. The prior art fails to teach a device or method allowing the user to be both comfortable and stimulated. The prior art also fails to teach a device or method that allows control of the stimulation stream through engagement between the device and the user's lower body. The common thread linking the failure of the prior art is the lack of individual control and choice of control for the user. This lack of teaching, to date, thus limits the effectiveness of using water for stimulation of the user.

SUMMARY OF THE INVENTION

The present art as described herein overcomes the deficiencies of the prior art. The apparatus disclosed and described herein addresses the weaknesses found in the prior art and improves hydrotherapy stimulation devices by providing a small mobile device capable of deployment within any shallow contained bathing area such as a spa, pool or bathtub. The device although mobile, is still fixable to the water container walls. The combination of removability and fixability allows the user to find a comfortable spatial relationship between the device, the user and the user's position in the contained bathing area, and then maintain that position. After establishing and fixing that relationship, the user may use the side engagement surfaces of the device to position the apparatus between the user's legs at a high comfort level, as determined by the user. The user may then also control directly at a fine level the water stream and thus the area of treatment during stimulation. Because treatment and stimulation are a dynamic process, the direct and indirect control surfaces allow the user to find the best stimulation area and rate of stimulation for the particular user, at a particular time.

A portable pumping unit contained in a housing designed to receive the female pelvic region and direct a focused aerated pulse of water at the same. Said portable hydro massage device when submerged in an enclosed body of water containing a female user, i.e. bathtub, provides a local massage to the labium region and a focused stimulant to the female user's clitoris thereby resulting in a superior sensation to the entire body promoting an overall euphoric state and calming effect. The apparatus employs a saddle shaped housing, where the buttocks are placed, and a saddle horn for controlling the concentration of the stimulus. Disposed within the midsection of the saddle horn is a hydro jet with a driven flow from a circulating water pump that draws suction from the main body of water. The hydro jet is adjustable in pressure and a method is provided for aeration of the water discharged to allow for a rhythmic pulsation effect. The saddle horn may be held and the lower body positioned as needed to focus the discharged water from the hydro jet to the desired point of the pelvic region.

The climatic effects are superior to the typical mechanical vibration devices and the prior hydro-therapeutic devices previously described. When operating, the female user has control of the unit to vary the angle and intensity of the stream and alternately sit or recline in a rested position with the legs extended or drawn up near the body. The device is portable and can be moved to different locations. A removably secure base, fixed to the bottom of the tub, is required to allow for a moderate amount of pressure from the user's pelvic to be applied to the unit.

It is therefore an objective of the invention to provide a hydrotherapeutic and stimulation method and device that allows fixable attachment within a self-contained bathing area.

It is another object of the invention to provide comfortable access between the user's legs without direct engagement of the apparatus with the user's vaginal region.

It is another objective of the invention to provide a utility for local concentrated stimulus to the female user's labium region that is socially acceptable and does not require penetration of the vaginal opening to achieve the desired effect.

It is another objective of the invention to combine close proximity of the discharge nozzle to the labium area with an adjustable discharge stream trajectory for user stimulation and "hands-free" adjustment. The inventor has realized the need for fine adjustments of the discharge nozzle at critical moments and mental concentration would be broken as the hand blocks the discharge stream or the device has to be moved away from the body to make adjustments.

It is another objective of the present invention to allow indirect adjustment of the discharge stream trajectory with minimal change of the discharge stream intensity by moving the housing of which the discharge nozzle is mounted.

BRIEF DESCRIPTION OF DRAWINGS

FIG. 6 is a perspective view of pivotal slide assembly.

FIG. 7 is a cross sectional view of pivotal slide assembly.

FIG. 8 is a rear elevational view of the preferred embodiment not employing a saddle.

FIG. 9 is a side elevational view of the preferred embodiment not employing a saddle.

FIG. 10 shows a partial cross sectional view of the preferred embodiment slide section with an extending rotatable pivot point.

FIG. 11 shows a typical bumper and method of attachment.

FIG. 14A shows a partial front elevation view of the saddle horn.

FIG. 14B shows a partial side sectional view of the saddle horn.

FIG. 14C shows a side elevation view of an extended pivotal bumper and attachment method.

FIG. 14D shows a side elevation view of a stationary bumper and attachment method.

FIG. 14E shows a top view of stationary bumper and attachment method.

FIG. 15A shows a front elevation view of the preferred embodiment.

FIG. 15B shows a side elevation sectional view of non-electric preferred embodiment.

FIG. 15C shows a side elevation view of the preferred embodiment in an alternate position.

DETAILED DESCRIPTION

Figure 1:
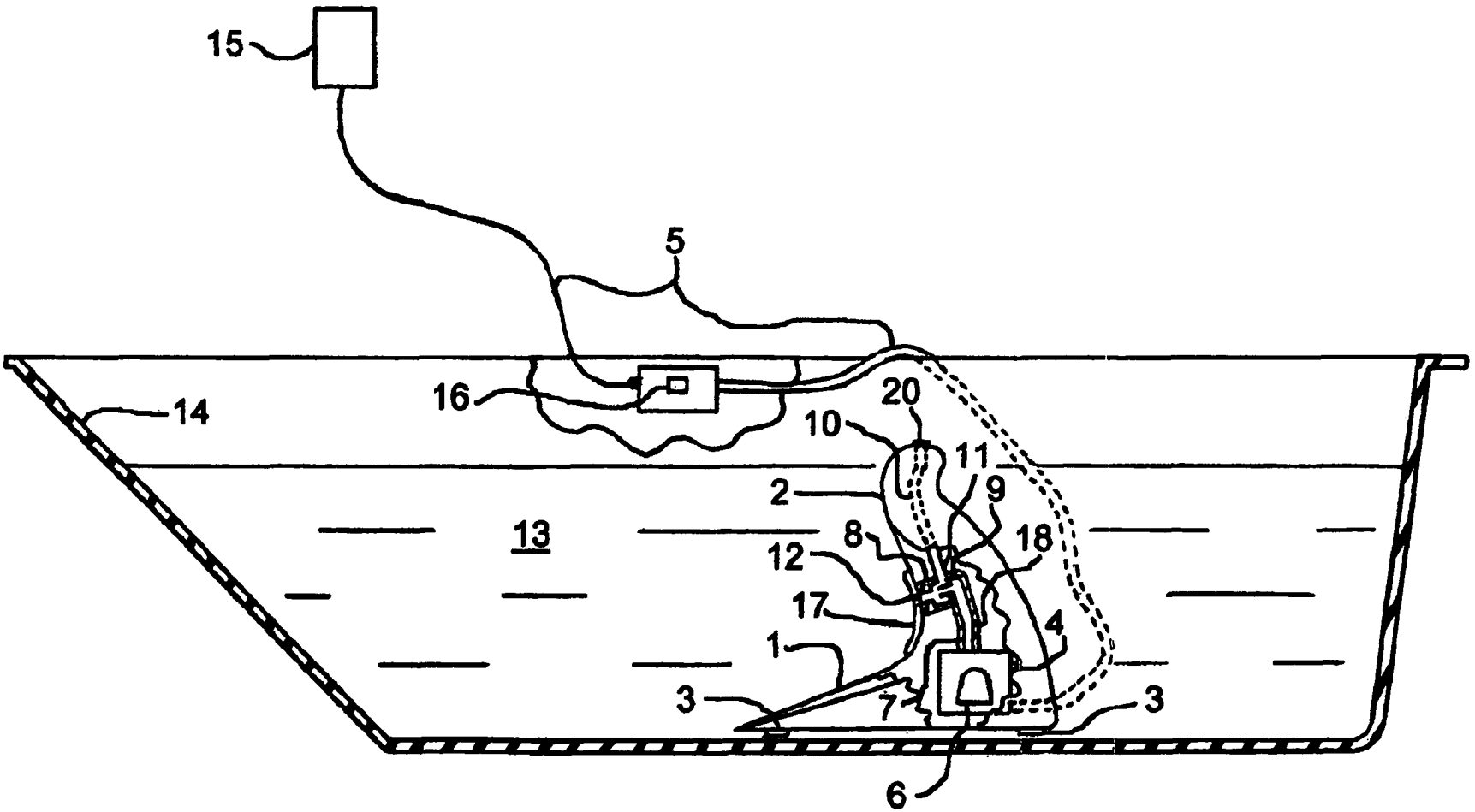
FIG. 1 is a side elevational view of the invention in a typical application. This first embodiment is shown in a sectional side view of a typical bathtub. The control unit is displayed attached to the outside wall of the bathtub.

Referring to FIG. 1, the hydro massage device is functional when submerged in a main body of water 13, e.g. contained in a standard bathtub 14. A hydro massage device consisting of a saddle 1, a partial seat which functions as a floodable housing for the internal parts and provides support for a variably disposed elongated protrusion from the forefront of the saddle heretofore referred to as the saddle horn 2. Said horn 2 is a handle which the user may hold for directional control of the device and may be formed in any number of shapes that would be of a comfortable grip to the user. Said saddle 1 is formed with a contour concave taper, sloping gradually from the rear of said saddle up to the fore of said saddle at the base of said horn 2 to aid in positioning the user's pelvic region into proximity of said horn 2 and act as a base for anchoring the device to the bottom of tub 14 using the weight of the user. Said saddle 1 employs slip resistant feet 3 to prevent the device from shifting foreword as the user mounts upon said device. Said saddle 1 contains a circulating water pumping unit 4, and electrical conductors 5 to feed low voltage direct current power from a conventional external AC to DC power supply 15 to said pumping unit 4. A switchable control 16 connected in the electrical power supply conductors 5 enables the user to turn on or off said pumping unit 4. In another embodiment a waterproof electrical switch may be employed within the device to allow the user to switch off and on the device and a sealed rechargeable battery may be employed within the saddle housing to provide the electricity needed to operate said pumping unit 4.

Figure 5:
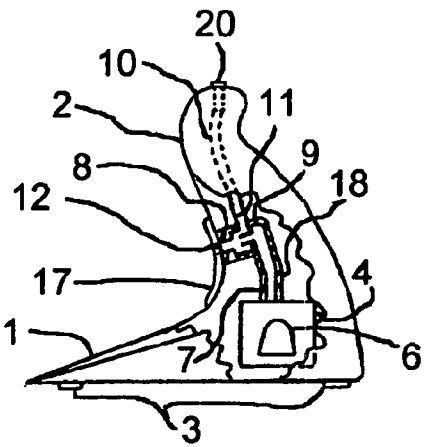
FIG. 5 is a right side elevational view of the first embodiment with a cutaway section of the housing to show the internal configuration of internal parts.

Referring to FIG. 1 and FIG. 5, said pumping unit 4 consists of a direct current electrical motor coupled to a centrifugal pump capable of running submerged in water and is common to those skilled in the art. Said pumping unit 4 has a suction inlet 6, which draws water, flooded within the housing, and discharges the water at a higher pressure and flow from the discharge 7 of said pumping unit 4. Disposed within said saddle horn 2 is hydro jet 8, an air-water structure means common to those skilled in the art, externally discharging through discharge nozzle or orifice 12 toward the female user from the mid section of the horn 2. A water inlet port 9 of said hydro jet 8 is in fluid communication through fluid conduit 18 extended to the discharge 7 of said pumping unit 4. Said hydro jet 8 increases the velocity of the water through a venturi effect to draw in air supplied by air suction conduit 10, connected at hydro jet air inlet 11, further extended above the surface of the water at the top of said horn 2 to provide aeration to discharge nozzle 12 of the hydro jet 8. An air control regulating valve 20, common to those skilled in the art, is employed in communication with said air suction conduit 10 to allow for variable airflow into the hydro jet and ultimately the intensity of the water discharged through nozzle 12 of said hydro jet 8. Air suction conduit 10 alternately may exit at any other desired point of the housing. Said hydro jet 8 is oriented such that the discharge nozzle 12 is directed at the female user's labium region when the female user is seated in the saddle 1.

Figure 4:
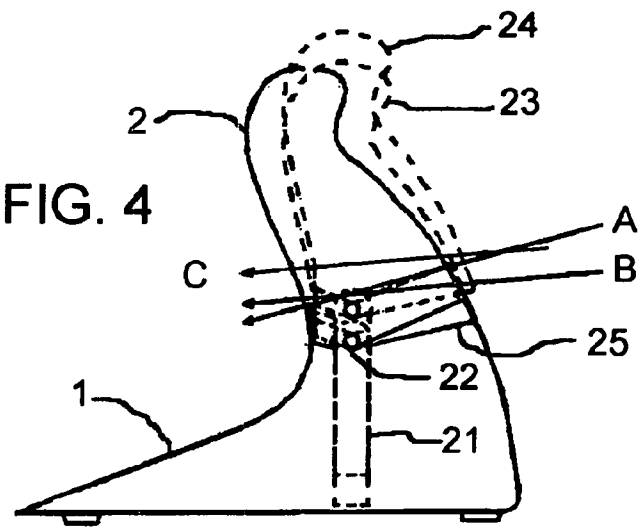
FIG. 4 is a right side elevational view of the first embodiment depicting the range of movement of the device.

Referring to FIG. 4 and FIG. 5, the vertical placement and orientation of said hydro jet 8 in relation to said saddle seat 1 is designed to accommodate a wide variety of female users. Shifting the pelvic region and or sitting verses reclining while positioned on the saddle seat 1 will allow the user to direct the massaging discharge of the said hydro jet 8 to the desired point of the labium region by moving said horn 2 with one or both hands. To utilize said horn 2 function to make adjustable the focus of the hydro jet 8 discharge trajectory, as referenced by trajectory lines A, B, and C, a pivotal point 22 is employed by a pivotal slide mechanism 21. An overlapping seam 25 is utilized to separate said saddle 1 from said horn 2. The internal lower extents of said horn 2 is pivotally connected at said pivot point 22 and in turn coupled to said slide mechanism 21. Said pivot point 22 and said slide mechanism 21, in conjunction with overlapping seam 25, allows said horn 2 to be moved vertically and or pivotally fore and back in relation to saddle 1. Said saddle housing 1 internally employs a recessed female socket whereas male portion of slide mechanism 21 is movably received to allow vertical movement of pivotally coupled said horn 2. Reference line A shows the trajectory of the discharge of said hydro jet 8 with said horn 2 at a first position. Reference line B shows trajectory of the discharge of said hydro jet 8 with said horn 2 pivoted foreword to a second position 23. Reference line C shows trajectory of discharge of said hydro jet 8 with said horn 2 extended vertically from second position 23 to a third position 24. The discharge trajectory from the hydro jet 8 is then variable, at the users discretion, as said horn 2 may be moved to any position within the range of the first position, said second position 23 and said third position 24. Vertical movement of said horn 2 to said third position 24 is limited by releasable stop tab employed in slide mechanism 21.

Referring to FIG. 6 and FIG. 7, releasable stop tab 28, engaged in aperture 29 of female slide section 30, is flexibly employed on male slide section 26 of said slide mechanism 21 to limit vertical movement which prevents slide mechanism 21 from disengaging during normal use but is releasable to allow slide mechanism 21 to be separated for device disassembly. Two male pivot parts 27, one not shown in FIG. 6, attach at the base of said saddle horn 2, engage both side ends of female pivot part of said male slide section 26 to allow pivotal movement of attached horn. Female slide section 30 is molded into base of said saddle housing. Two male pivot parts 27 can be molded into base of said horn 2. Slide mechanism 21 may employ a ball and socket pivot point to perform the same function as described above additionally providing for a rotatably swiveled pivot point and a greater range of trajectory paths from the hydro jet discharge.

Referring to FIG. 8, FIG. 9, and FIG. 10, a preferred embodiment is depicted without the need for a saddle seat allowing the female user to affix the device directly to the bottom of the tub, between the legs, and adjust movement of said horn 2 as desired. The preferred embodiment is functionally identical as the first, and employs the same mechanical and electrical parts to operate. The slide mechanism, however, is modified to allow said horn 2 to be used independent from a saddle housing. This preferred embodiment employs a ball and socket pivot point 31 at the base of horn 2, providing for an extending rotatably swiveled pivot point. Suction cup 32 receives ball end of male slide section 33 allowing for a removably fixed attachment to the bottom of tub. Female slide section 37 is molded into base of saddle horn 2 to receive said male slide section 33 allowing said horn 2 to be moved pivotally within the physical range of ball and socket pivot point 31. A stop tab 35 is molded into male slide section 33 which will impinge on stop collar 34 to prevent the slide assembly from disengaging when extended to its physical range of motion.

Figure 2:
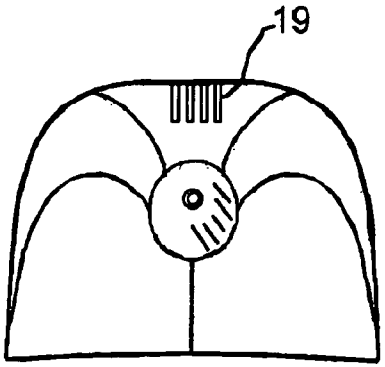
FIG. 2 is a top plan view of the first embodiment.

Referring to FIG. 2, the floodable housing is shown in the top view with slots 19 which communicate the surrounding water to the interior of the device. It is desired to include a filter assembly at slots 19 to prevent debris from entering the pumping unit. Apertures, functionally identical to said slots 19, may be utilized beneath the housing to allow water to be pulled in and flood the internal cavity from the bottom of the housing.

Figure 3:
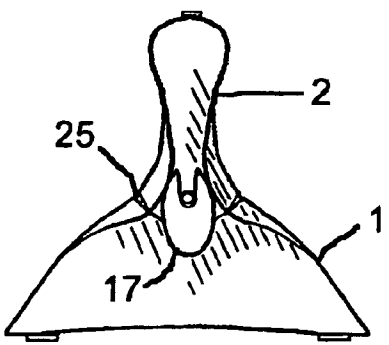
FIG. 3 is a rear elevational view of the first embodiment.

Referring to FIG. 3, FIG. 12, and FIG. 13, externally surrounding the outlet of the hydro jet 8 is a bumper 17 allowing for comfortable pressing of the user's pelvic region to said horn 2 as desired. Said bumper 17 is attached to horn 2 and not to saddle 1 thereby extending over said seam 25. As said horn 2 is moved to a variable position, said seam 25 will not be exposed to the user's labium region. Bumper 17 can be designed to enhance the user's experience and function to maintain small distance between the user and the exterior edge of the discharge of hydro jet 8 to prevent blocking of the discharge flow. Bumper 17 is employed in all embodiments to perform a similar function.

Figures 12A, 12B, 13A, 13B:
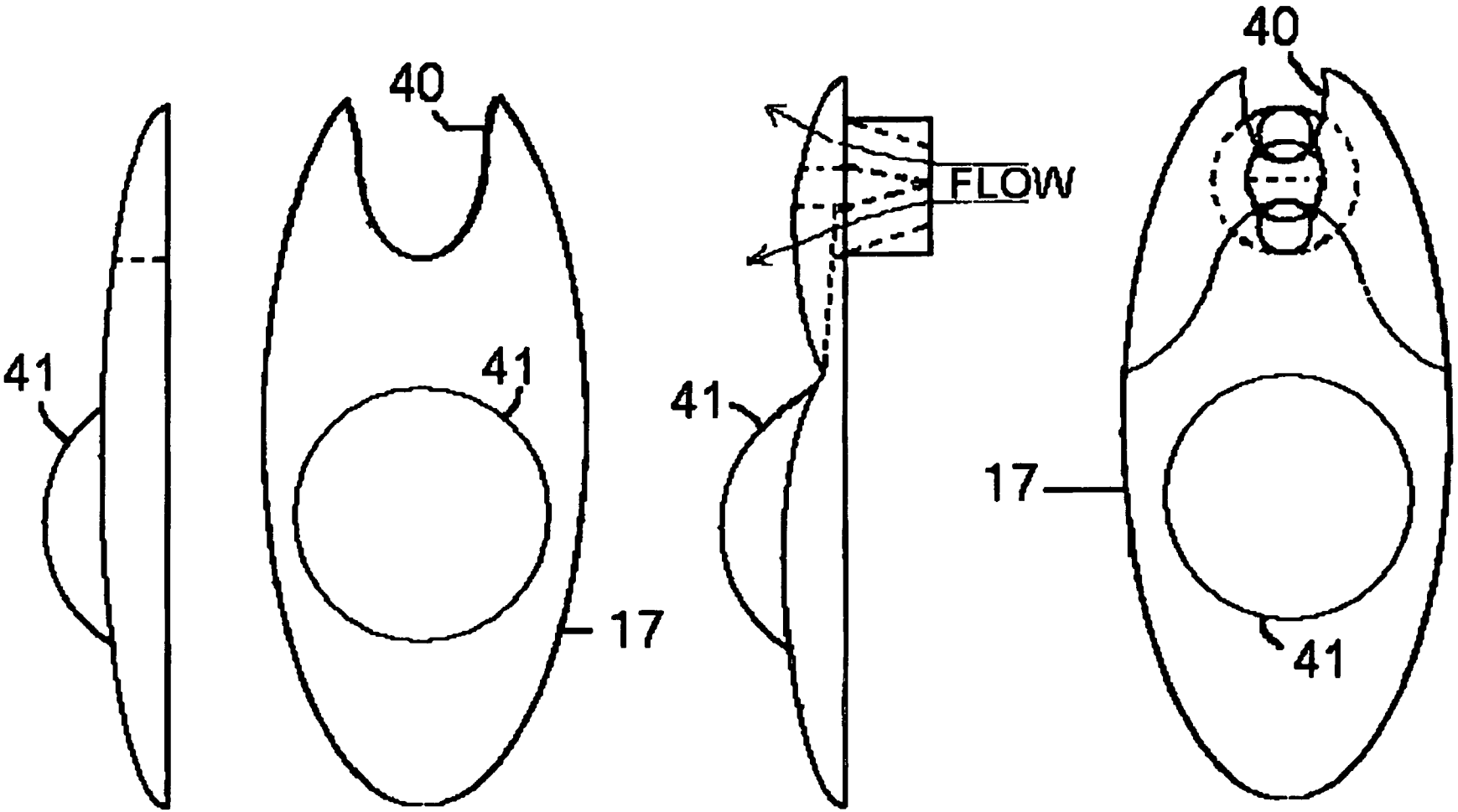
FIGS. 12A and 12B shows an optional bumper that maintains clearance from the user in relation to the discharge of the hydro jet.
FIGS. 13A and 13B shows an optional bumper that maintains clearance from the user in relation to the discharge of the hydro jet and splits the discharge flow into two separate streams.

Referring to FIG. 12 and FIG. 13, two different embodiments of said bumper 17 are depicted, respectively. In both embodiments, as shown in FIGS. 12B and 13B, said bumper 17 has a relief cutaway portion 40 at the top of said bumper 17 and a thickness to maintain a path for discharge flow from the hydro jet 8 if the user presses the labium region hard against bumper 17. A nodal protrusion 41 is employed to stimulate the vaginal opening and can be of various shapes and lengths. The embodiment of the bumper 17 shown in FIGS. 13A and 13B, is configured such that the single discharge flow from the hydro jet 8 is split into two channel streams, one directed up and the second down, to provide further stimulation through water contact at two distinct points. Although not shown, those practiced in the arts will understand that it is also contemplated by the inventor to modify bumper 17 with other variations of cutaway portion 40 to include a plurality of channel streams emitting from said hydro jet device.

Referring to FIG. 11 and FIG. 8, said bumper 17 is removeably attached to the rear face of said horn 2 immediately below hydro jet discharge nozzle 12 by means of a bow tie shaped aperture 38. Aperture 38 receives a corresponding male part 39 fixed to the base 36 of bumper 17. Male part 39 is locked into aperture 38 by inserting, then twisting 90 degrees to lock the bumper base into place. This feature allows a variety of bumper shapes to be interchanged as desired by the user or removed for cleaning or replacement.

Referring to FIGS. 14A-E, the preferred method of bumper attachment to horn 2 is utilized with ball and socket joints. Female ball sockets 42, made of rubber, are disposed above and or below the hydro jet discharge nozzle 12 to allow a pivotal attachment, as in 14C, or a stationary attachment of bumper 17 shown in 14D,E to allow the user to easily attach and remove for interchange, and connect attachments to any available socket. Male portion 44 of ball joint, made of plastic, is molded into fixed bumper 17 or a variably disposed phallus extension 43. With this method of attachment, said phallus extension 43 is pivotal at the attached end and will allow for angular changes as the user shifts position of said horn 2. A wide variety of bumper shapes, both stationary and pivotal, can be designed and made to attach with this method.

FIGS. 15A-C depict an alternative embodiment of the present invention employing an externally supplied water source via hose 48 instead of an electric pump. Supply hose 48, connected to hydro jet inlet 18 is in fluid communication with a bathtub waterspout or a jet nozzle of a hot tub, or any other water pressure source. The air suction conduit 10 may be routed within the housing and exit at any penetration point on the housing and extend to the air space above the water line. Hydro jet 8 discharges the mixture of air and water at discharge nozzle 12 when water under pressure is supplied through hose 48 and air is venturied in through air suction conduit 10. This means eliminates the need for an electric power source and pump with no loss of function.

In FIG. 15B the base of the unit is chamfered at 49 to the back base of the lower housing to such a degree that the unit can be tilted back, FIG. 15C, with the slide extension 21, fixed and extended, and optional suction cup 46 making a fixed second point of contact. This feature removeably fixes the device in a stationary position and allows hands free operation during stimulation.

In FIG. 15C, the upper extents of the horn 2 can be coated, textured, or an inlay made of a rubber compound 45 to make a non-slip, comfortable grip for the user. A series of ridges 52, FIG. 15B, may also be employed at the back or front of neck on said horn 2 to provide a gripping surface. Said horn 2 is slender and a plurality of shapes may be designed to fit comfortably in the hand of the average female user.

In FIG. 15B, vent hole 51 is utilized to continuously remove air from the internal volume as housing 1 floods with water from the bottom and the air is displaced. Said vent hole 51 is located at the top of said horn 2 to minimize buoyancy of the device.

In a typical session the female user places said saddle 1 into a tub of water drawn to the desired temperature to suit the bather. Said switchable unit 16 is placed on the outside edge of the tub and the electrical supply 15 is plugged into the switchable unit 16. The female user may now enter the bath and position said saddle 1 to a desired distance from the back of said tub 14 and take a seated position on said saddle 1. The user may now turn on the power to the device at said switchable unit 16 and adjust the seating position in the saddle 1 or recline her upper torso against the rear wall of the tub 14. The user's legs may be extended without interference or may be drawn up in a splayed position. Placing a hand on said horn 2 as leverage, the female user now may position her pelvic region at the desired distance from or up to said bumper 17. The user may adjust the velocity of the air-water mixture discharging from hydro jet 8 by adjusting said air control valve 20 to the desired stimulation intensity. Said horn 2 may be moved to a plurality of positions to fine tune the trajectory of the discharge stream to focus the discharge at the desired stimulation point(s).

The materials required to construct the unit could be of injection molded or blow molded plastic. The bumper can be made of silicone, soft plastic or rubber compound. The pumping unit is common to those skilled in the art as well as the hydro jet and all required tubing and electrical parts to construct the device.

It will be understood that certain features and sub-combinations are of utility and may be employed without reference to other features and sub-combinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The invention claimed is:

1. A method of hydrotherapeutic stimulation of the female clitoral region in a contained water vessel using a hydro jet device compromising the following steps:

a. Positioning the user within the contained water vessel;

b. Placing the hydro jet device under the water between the user's legs in proximity to said user's vagina;

c. Inserting a portion of the exterior of the hydro jet device in said user's vagina to fix the spatial relationship and position of the hydro jet device in relation to the user's vagina and clitoris;

d. Engaging the exterior of the hydro jet device and the user's body;

e. Accelerating and combining water and air in the hydro jet device to produce an air-water stream under pressure;

f. Discharging said air-water stream towards said user's clitoral region for clitoris stimulation; and, g. Allowing the user to control the exterior of the hydro jet device through engagement with said user's lower body for vaginal stimulation while simultaneously allowing the user to control the discharge trajectory and intensity of said air-water stream during engagement and stimulation of said user's clitoral region.

2. The method of hydrotherapeutic stimulation of the female clitoral region according to claim 1 wherein said portion of the exterior of the hydro jet device inserted in said user's vagina to fix the spatial relationship between the user and the hydro jet device is an attachment which is detachable from the hydro jet device.

3. The method of hydrotherapeutic stimulation of the female clitoral region according to claim 2 wherein said attachment is phallic shape.

* * * * *